US005886509A

United States Patent [19]

Fischer et al.

[11] Patent Number: 5,886,509

[45] Date of Patent: Mar. 23, 1999

[54] VOLTAGE STABILIZER HAVING AN INPHASE REGULATOR

[75] Inventors: Werner Fischer, Heimsheim; Walter Grote, Markgroeningen, both of Germany

[73] Assignee: Robert Bosch GmbH, Stuttgart, Germany

[21] Appl. No.: 42,166

[22] Filed: Mar. 13, 1998

[30] Foreign Application Priority Data

Mar. 19, 1997 [DE] Germany ..... 197 11 364.8

[51] Int. Cl.[6] ..... G05F 1/40

[52] U.S. Cl. ..... 323/268

[58] Field of Search ..... 323/268, 272, 323/224, 225; 327/404, 408

[56] References Cited

U.S. PATENT DOCUMENTS

| | | | |
|---|---|---|---|
| 4,628,438 | 12/1986 | Montague | 363/134 |
| 4,712,171 | 12/1987 | Yamashita | 363/142 |
| 4,816,739 | 3/1989 | Sakurai et al. | 323/272 |
| 5,216,351 | 6/1993 | Shimoda | 323/224 |

*Primary Examiner*—Shaun Riley
*Attorney, Agent, or Firm*—Kenyon & Kenyon

[57] ABSTRACT

A voltage stabilizer, having at least one supply-voltage input and at least one load-voltage output, has an in-phase regulator which is connected between the supply-voltage input and the load-voltage output. Provision is made for at least a first switching element, by means of which a first resistor is switchable in series to the in-phase regulator.

12 Claims, 1 Drawing Sheet

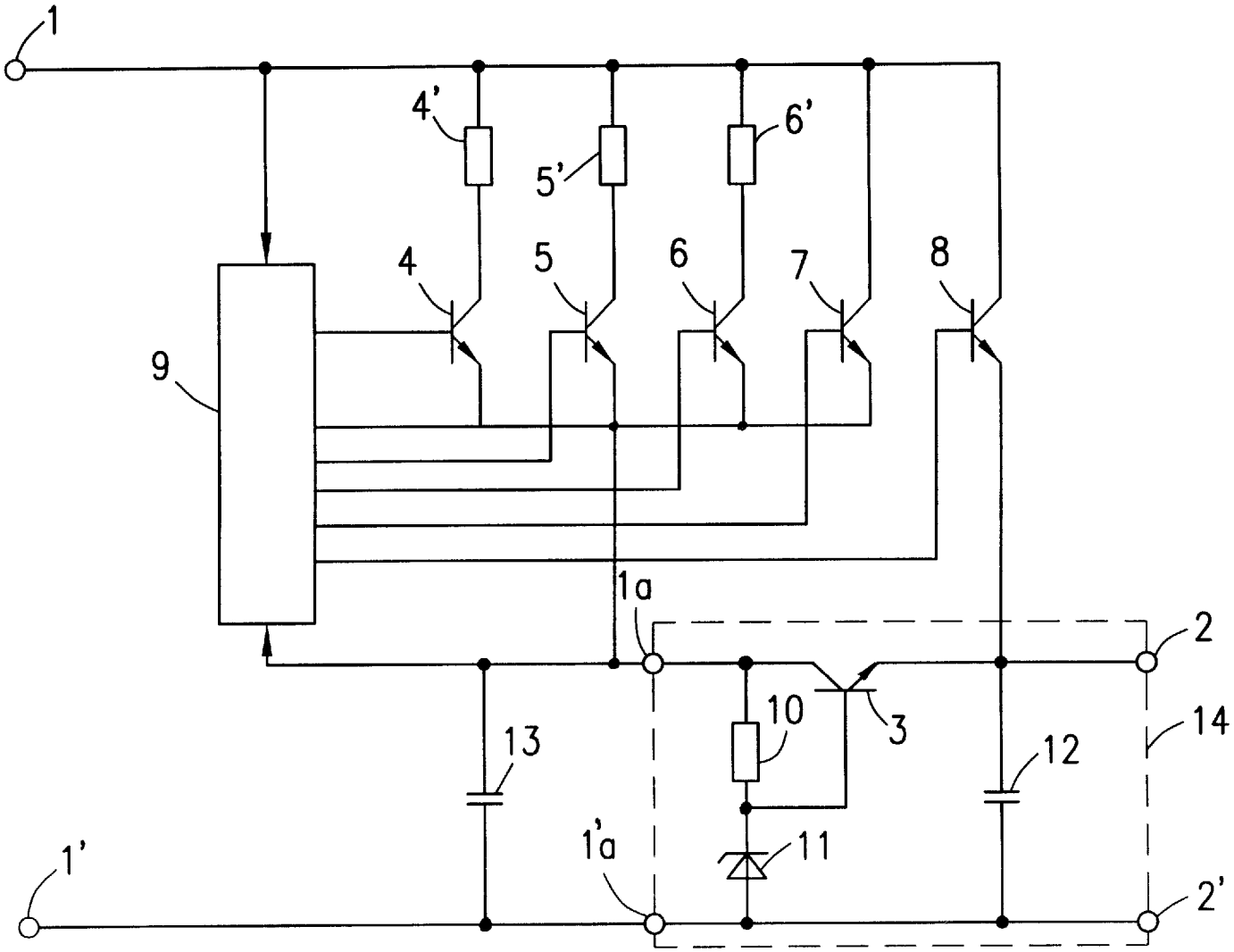
1
1'
1a
1'a
2
2'
3
4
4'
5
5'
6
6'
7
8
9
10
11
12
13
14

VOLTAGE STABILIZER HAVING AN INPHASE REGULATOR

FIELD OF THE INVENTION

The present invention relates to a voltage stabilizer having at least one supply-voltage input and at least one load-voltage output, in which an in-phase regulator is connected between the supply-voltage input and the load-voltage output.

BACKGROUND INFORMATION

A voltage stabilizer is known in the related art. It is usually used, modified in various ways. The voltage stabilizer has additional smoothing and control elements depending on the demands made on it.

Voltage-supply devices for motor vehicles, in particular, require a special design. The vehicle voltage system already fluctuates within wide limits depending on whether the vehicle battery is charged or discharged, whether the vehicle engine is running or not, whether the ambient temperature is low or high, or whether there is sufficient battery fluid in the battery.

Furthermore, it may be necessary to compensate for considerable voltage jumps which occur when a low-resistance load such as the engine starter, the rear defroster or the high beams are switched on or off. A multitude of voltage peaks of different leading edge and different amplitude, which can be caused by ignition processes or the switching of capacitive or inductive loads, can also be superimposed on the supply voltage.

For the voltage supply of electronic loads in motor vehicles, a voltage-supply device is known which furnishes a load voltage that lies below the supply voltage, but is limited to a specifiable maximum value such as 9 volt or 12 volt. This load voltage is not stabilized; however voltage jumps in response to load changes are compensated. Furthermore, by means of the known voltage-supply device, a second load voltage is generated which is stabilized to a fixed, specifiable value and in the case of which, all load changes are compensated very quickly. Both load voltages are generated by means of an in-phase regulator connected between the supply-voltage input and the respective load-voltage output.

Achieved by special circuitry measures is that, given small supply voltages at the in-phase regulator, a small voltage drop occurs.

Disadvantageous in the last-named voltage-supply device, but also in the case of all other known voltage-supply devices which have an in-phase regulator connected between the supply-voltage input and the load-voltage output, is that the excess voltage drops off at the in-phase regulator, which means a relatively large power loss occurs at the in-phase regulator. The dissipation power is completely converted into heat which heats the voltage-supply device in an unwanted manner. This is very disadvantageous particularly in the case of voltage stabilizers constructed using hybrid technology, since due to this, the output power of the voltage stabilizers is limited.

Therefore, given voltage stabilizers of great power, it is necessary to resort to costly measures to dissipate the power-loss heat. In addition, subject to the power loss, the electric circuit must not fall below a certain size.

An object of the present invention is to design a voltage stabilizer in such a way that, given great output power, the design of the electric circuit can be kept small.

SUMMARY OF THE INVENTION

According to the present invention, provision is made for at least a first switching element, by means of which a first resistor is switchable in series to the in-phase regulator. Achieved by the series connection of the first resistor to the in-phase regulator is that the difference of the supply voltage to the load voltage is distributed on the in-phase regulator and the first resistor. In this manner, a portion of the dissipation power developing during the voltage stabilization is received in an advantageous manner by the first resistor.

If the first resistor is arranged at a spatial distance from the in-phase regulator and the remaining components of the actual voltage stabilizer, the electrical stabilizer circuit is not stressed heat-wise by the power loss arising at the first resistor. Since less heat develops in the voltage stabilizer itself, the components of the voltage stabilizer can be arranged spatially close together, thus advantageously reducing the design of the voltage stabilizer. Due to the circuit configuration of the present invention, an evacuation of the dissipation power from the voltage stabilizer is virtually possible. The entire power loss, over a large supply-voltage range and adapted to the current consumption of the circuit, can be optimally distributed on the actual voltage stabilizer and the first resistor.

It has turned out to be particularly favorable to arrange the first resistor between the supply-voltage input and the in-phase regulator. By this means, it is possible to modify any voltage-stabilizer circuit whatever in the manner according to the present invention. It is possible to subsequently provide conventionally constructed voltage stabilizers with a resistor connected in advance of the input of the voltage stabilizer. The resistor can be placed spatially at a location which is well suited for dissipating the heat produced in the resistor.

The circuit configuration of the present invention can also be improved by providing a second switching element, by means of which a second resistor is switchable in parallel to the first resistor. Such a switching element makes it possible to change in a simple manner the resistance value connected in advance of the in-phase regulator. By changing the total resistance upstream of the in-phase regulator, the voltage drop occurring at the upstream total resistance, and thus the power loss, can be adjusted.

By means of a plurality of further switching elements, i.e. by means of the switching elements of further resistors switchable in parallel to the first resistor, the voltage at the input of the in-phase regulator can be adjusted approximately to a fixed value. The voltage can be adjusted, in that initially, a resistor having the greatest resistance value is switched in series to the in-phase regulator (in parallel) by means of a suitable switching element. If the voltage drop across the resistor connected in series to the in-phase regulator is so great that the in-phase regulator reaches saturation, an additional resistor is switched, by means of a suitable switching element, in parallel to the resistor series-connected to the in-phase regulator. Due to the parallel connection of the additional resistor, the value of the total resistance upstream of the in-phase regulator is reduced. Thus, the in-phase regulator can perform its controller function again until it once more reaches saturation because of an increased load current. If the in-phase regulator again reaches saturation, another resistor is connected in parallel, as a result of which the process described above repeats itself.

The process repeats itself until at the end, for example, a fourth switching element connects the supply-voltage input directly to the input of the in-phase regulator. This is the case, for instance, when the supply voltage has fallen to a value which is somewhat greater than the load voltage. By the direct connection of the supply-voltage input to the input of the in-phase regulator, the total resistance upstream of the in-phase regulator is bypassed. That is to say, the supply voltage is applied directly to the input of the in-phase regulator, which means the entire power loss drops at the in-phase regulator. Since, however, the power loss is relatively low because of the decreased supply voltage, the voltage stabilizer is not very strongly stressed heat-wise.

In a further specific embodiment of the present invention, provision is made for a fifth switching element, by means of which the supply-voltage input is able to be connected directly to the output of the in-phase regulator. If the fifth switching element has a lower saturation voltage than the in-phase regulator, the voltage stabilizer can still be used in the case of supply voltages which are only slightly greater than the load voltage.

In an advantageous manner, control can be provided, by means of which the switching elements are controlled in open loop as a function of the voltage at the supply-voltage input. However, the switching elements can also be controlled in open loop and closed loop, respectively, as a function of the voltage at the input of the in-phase regulator, if this should be advantageous. In particular, the switching elements can be so controlled in closed loop, one after the other, that the voltage at the input of the in-phase regulator remains constant. If transistors are used as switching elements, the circuit configuration of the present invention can be implemented in a simple manner.

In another specific embodiment of the present invention, a smoothing capacitor is connected between the input of the in-phase regulator and ground. The voltage at the input of the in-phase regulator is smoothed in advantageous manner by the smoothing capacitor. The smoothed input voltage punches through via the in-phase regulator to the output voltage. Due to this, it is possible to fall back upon a very small smoothing capacitor at the output of the in-phase regulator to smooth the output voltage of the in-phase regulator.

Although the circuit arrangement of the present invention was described on the basis of one in-phase regulator for the generation of a single supply voltage, it can also be easily used in the case of voltage regulators which are designed for generating a plurality of load voltages, i.e. have a plurality of regulating units.

BRIEF DESCRIPTION OF THE DRAWINGS

The FIGURE shows a circuit configuration of the present invention in schematic representation.

DETAILED DESCRIPTION

As can be seen in the FIGURE, the circuit arrangement of the present invention is made of a conventionally constructed voltage stabilizer 14. Voltage stabilizer 14 is made of a voltage divider composed of a series resistor 10 and a Zener diode 11. Voltage divider 10,11 is connected between two input terminals 1*a*, 1*a*' of conventional voltage stabilizer 14. First input terminal 1*a* is furthermore connected to the collector of a transistor 3 used as an in-phase regulator. The base of transistor 3 is connected to the center tap of voltage divider 10,11. The emitter of transistor 3 is connected to the output terminal of the conventional voltage stabilizer, which also forms an output terminal of the voltage stabilizer of the present invention. Second input terminal 1*a*' is connected directly to second output terminal 2' of conventional voltage stabilizer 14, i.e. the voltage stabilizer of the present invention. A first smoothing capacitor 12 is connected between output terminals 2,2'.

First input terminal 1*a* of conventional voltage stabilizer 14 is connected to an emitter of a first transistor 4. The collector of first transistor 4 is connected via a first resistor 4' to a first input terminal 1 of the voltage stabilizer of the present invention, to which the supply voltage is applied.

A second resistor 5' is connected in parallel to first resistor 4' by means of a second transistor 5, and a third resistor 6' is connected by means of a third transistor 6. That is to say, the emitter of second transistor 5 and the emitter of third transistor 6 are connected to first input terminal 1*a* of conventional voltage stabilizer 14. The collector of second transistor 5 and the collector of third transistor 6 are connected via second resistor 5' and third resistor 6' to first input terminal 1 of the circuit arrangement according to the present invention.

In addition, the emitter of a fourth transistor 7 is connected to first input terminal 1*a* of conventional voltage stabilizer 14. The collector of fourth transistor 7 is connected directly to first input terminal 1 of the circuit arrangement according to the present invention.

Moreover, the emitter of a fifth transistor 8 is connected to output terminal 2. The collector of fifth transistor 8 is connected directly to first input terminal 1 of the circuit arrangement according to the present invention.

The base terminals of transistors 4 to 8 are connected to a control 9, which is likewise connected to first input terminal 1 of the circuit arrangement of the present invention, and to first input terminal 1*a* of conventional voltage stabilizer 14.

Second input terminal 1' of the circuit arrangement according to the present invention is connected directly to second input terminal 1*a*' of conventional voltage stabilizer 14. A second smoothing capacitor 13 is connected between first input terminal 1*a* and second input terminal 1*a*' of conventional voltage stabilizer 14.

The circuit configuration of the present invention permits, in an advantageous manner, the voltage at first input terminal 1*a* of conventional voltage stabilizer 14 to be controlled in closed loop to a fixed value. To that end, control 9 initially biases first transistor 4 into conduction, whereby the supply voltage, via first resistor 4' which is the resister having the greatest power loss, is applied to first input terminal 1*a* of conventional voltage stabilizer 14, i.e. to the collector of transistor 3 used as the in-phase regulator. If the voltage at the collector of transistor 3, used as the in-phase regulator, reaches a value, such that transistor 3 reaches saturation, in addition second resistor 5' is switched in parallel to first resistor 4' by means of second transistor 5. By this means, the total resistance switched in series to transistor 3, used as the in-phase regulator, is reduced. If, for example, transistor 3 again reaches saturation because of a decreased supply voltage or an increased output current, the process described above repeats itself, i.e. third resistor 6' is switched in parallel to first resistor 4' and second resistor 5' by means of third transistor 6. Of course, only third resistor 6', or a parallel connection composed of an arbitrary combination of resistors 4', 5', 6', can also be switched in series to transistor 3 used as the in-phase regulator.

Finally, fourth transistor 7 is biased into conduction, whereby the supply voltage is applied directly to the input of conventional voltage stabilizer 14. If the supply voltage decreases still further, fifth transistor 8 is biased into conduction, whereby transistor 3, used as the in-phase regulator, is bypassed, and the supply voltage is applied directly to output 2 of the voltage stabilizer.

What is claimed is:

1. A voltage stabilizer having at least one supply-voltage input and at least one load-voltage output, comprising:

an in-phase regulator coupled between the at least one supply-voltage input and the at least one load-voltage output;

at least one first resistor; and at least one first switching element for selectively switching the at least one first resistor in series to the in-phase regulator.

2. The voltage stabilizer according to claim 1, wherein the at least one first resistor is arranged between the at least one supply-voltage input and the in-phase regulator.

3. The voltage stabilizer according to claim 1, further comprising at least one second resistor and at least one second switching element for selectively switching the at least one second resistor in parallel to the at least one first resistor.

4. The voltage stabilizer according to claim 3, further comprising at least one third resistor and at least one third switching element for selectively switching the at least one third resistor in parallel to the at least one first resistor.

5. The voltage stabilizer according to claim 4, further comprising a fourth switching element for selectively directly connecting the at least one supply-voltage input to an input of the in-phase regulator.

6. The voltage stabilizer according to claim 5, further comprising a fifth switching element for selectively directly connecting the at least one supply-voltage input to an output of the in-phase regulator.

7. The voltage stabilizer according to claim 1, further comprising a control element for controlling the at least one first switching element in an open-loop as a function of a voltage at the at least one supply-voltage input.

8. The voltage stabilizer according to claim 1, further comprising a control element for controlling the at least one first switching element in an open-loop as a function of a voltage at an input of the in-phase regulator.

9. The voltage stabilizer according to claim 1, further comprising a smoothing capacitor coupled between an input of the in-phase regulator and a ground.

10. The voltage stabilizer according to claim 1, wherein the at least one first switching element includes a transistor.

11. The voltage stabilizer according to claim 1, wherein the at least one first switching element is controlled in a closed-loop as a function of a voltage at an input of the in-phase regulator.

12. The voltage stabilizer according to claim 6, wherein the at least one first switching element, the at least one second switching element, the at least one third switching element, the fourth switching element and the fifth switching element are controlled in a closed-loop, one after the other, such that a voltage at an input of the in-phase regulator remains constant.

* * * * *